US012109472B2

(12) United States Patent
Sartore

(10) Patent No.: US 12,109,472 B2
(45) Date of Patent: Oct. 8, 2024

(54) SUPPORT DEVICE FOR THE FRONT WHEEL OF A BICYCLE

(71) Applicant: ELITE S.R.L., Fontaniva (IT)

(72) Inventor: Andrea Sartore, Fontaniva (IT)

(73) Assignee: ELITE S.R.L., Fontaniva (IT)

( * ) Notice: Subject to any disclaimer, the term of this patent is extended or adjusted under 35 U.S.C. 154(b) by 113 days.

(21) Appl. No.: 17/559,503

(22) Filed: Dec. 22, 2021

(65) Prior Publication Data

US 2022/0203197 A1 Jun. 30, 2022

(30) Foreign Application Priority Data

Dec. 24, 2020 (IT) ..... 102020000032420

(51) Int. Cl.
*A63B 69/16* (2006.01)

(52) U.S. Cl.
CPC ..... *A63B 69/16* (2013.01); *A63B 2069/162* (2013.01); *A63B 2069/163* (2013.01); *A63B 2225/093* (2013.01)

(58) Field of Classification Search
CPC ..... A63B 69/16; A63B 2069/162; A63B 2069/163; A63B 2225/093; A63B 21/00192; A63B 21/005; A63B 21/008; A63B 21/0085; A63B 2069/165; A63B 2225/09; A63B 71/023; A63B 22/0605; A63B 22/0023
USPC ..... 248/177.1, 178.1; 482/57, 61, 65
See application file for complete search history.

(56) References Cited

U.S. PATENT DOCUMENTS 4,775,145 A * 10/1988 Tsuyama ..... A63B 21/0052 482/901
4,802,666 A * 2/1989 Rodriqguez ..... G09B 9/058 482/61
5,042,795 A * 8/1991 Bursik ..... A63B 69/16 482/61
6,712,737 B1 * 3/2004 Nusbaum ..... A63B 69/16 482/8
7,691,033 B2 * 4/2010 Rolli ..... A63B 22/0056 482/146
7,736,282 B1 * 6/2010 Horowitz ..... A63B 69/16 482/61
10,112,098 B2 * 10/2018 Smits ..... A63B 69/16
10,384,111 B2 * 8/2019 Liao ..... A63B 24/0087
10,695,638 B2 * 6/2020 Hawkins, III ..... A63B 24/0062
(Continued)

FOREIGN PATENT DOCUMENTS

EP 0995466 A1 4/2000
GB 2561830 A 10/2018
(Continued)

*Primary Examiner* — Muhammad Ijaz
(74) *Attorney, Agent, or Firm* — Volpe Koenig

(57) ABSTRACT

A support device for a bicycle includes a support structure, a fixing group supported on the support structure and also includes a movable element and a retention element configured to hold the front fork of the bicycle. The support device also includes a lifting/lowering device of the fixing group, in which the retention element is integral in translation with the movable element. The support device further includes connection means configured for slidingly fixing said fixing group to the support structure in such a way as to allow displacements of the fixing group with respect to the support structure along a compensation direction transverse to the vertical direction.

16 Claims, 6 Drawing Sheets

(56) References Cited

U.S. PATENT DOCUMENTS

| | | | | |
|---|---|---|---|---|
| 11,141,625 | B2 * | 10/2021 | McAllister | A63B 22/0605 |
| 2006/0229163 | A1 * | 10/2006 | Waters | A63F 13/22 482/8 |
| 2009/0283648 | A1 | 11/2009 | Chiang et al. | |
| 2011/0039664 | A1 * | 2/2011 | Cooper | A63B 24/0087 482/61 |
| 2016/0096098 | A1 * | 4/2016 | Wang | A63B 23/0476 482/61 |
| 2018/0008856 | A1 * | 1/2018 | Radow | A63B 69/16 |
| 2018/0369675 | A1 * | 12/2018 | Papadopoulos | A63B 69/16 |
| 2019/0022457 | A1 * | 1/2019 | Porwal | A63B 21/4009 |
| 2019/0022497 | A1 * | 1/2019 | Hawkins, III | A63B 24/0087 |
| 2020/0324840 | A1 * | 10/2020 | Maxfield | A63B 26/003 |
| 2021/0162291 | A1 * | 6/2021 | Lee | A63B 69/16 |
| 2021/0269111 | A1 * | 9/2021 | Kotlar | B62H 7/00 |
| 2022/0203197 | A1 * | 6/2022 | Sartore | A63B 71/023 |
| 2022/0203198 | A1 * | 6/2022 | Sartore | A63B 71/023 |
| 2022/0387870 | A1 * | 12/2022 | Yu | A63B 22/0605 |

FOREIGN PATENT DOCUMENTS

| | | | |
|---|---|---|---|
| JP | 2018121809 | A | 8/2019 |
| NL | 2006702 | C2 | 11/2012 |
| WO | 2007083341 | A1 | 7/2007 |
| WO | 2019018416 | A1 | 1/2019 |

* cited by examiner

SUPPORT DEVICE FOR THE FRONT WHEEL OF A BICYCLE

FIELD OF THE INVENTION

The present invention relates to a support device for the front wheel of a bicycle, of the type usable in combination with a roller support for the rear wheel of bicycles, or to other similar training devices.

BACKGROUND

In the cycling sector, the use of so-called rollers or trainers is widespread, that is, devices intended for training in closed environments through which the bicycle may be supported on fixed supports and capable of producing an adjustable braking action on pedaling.

In the context of these devices, the need is felt to be able to recreate situations and conditions that are increasingly similar to those which actually occur in the context of actual cycling practice on the road and outdoors in general.

As part of this need, numerous solutions have been developed aimed at recreating the real conditions that the cyclist may feel during outdoor training and being able to work interactively with the cyclist's activity.

In view of this interactivity, front wheel supports have also been developed which are able to simulate the slopes of the road surface, tilting the bicycle up or down to simulate uphill or downhill stretches. This position may therefore be accompanied by an appropriate variation in the pedaling resistance offered by the roller or by the trainer which allows simulating the ascent or descent condition.

An example of this type of support is described in the international patent application WO 2019/018416 which relates to a training device for bicycles which comprises an essentially vertical guide element and a shoe designed to fix the front hub of the bike. The shoe is able to slide along the guide element by means of a belt driven by an electric motor. The guide element is therefore capable of making the shoe slide in a substantially vertical direction, so as to raise and lower the front end of the bicycle.

In order to maintain the correct distance between the axis of the rear wheel of the bicycle and the fixing point of the front hub thereof on the shoe, it is also possible to make the guide element oscillate with respect to a horizontal axis and parallel to the wheel axes.

In fact, it should be understood that the aforementioned distance undergoes variations for purely geometric reasons during the vertical movement of the shoe, variations which must be compensated for in order to allow the training device to function correctly.

The international patent application WO 2019/018416 essentially describes two different solutions for carrying out this compensation.

In a first embodiment, the base of the guide element has a curved shape in such a way as to allow the entire device to oscillate according to the compensation required.

A second embodiment, on the other hand, provides for mounting the guide element on a base which may be oscillated by means of a pin. Also with this solution, therefore, the guide element may tilt forward and backward following the vertical movement of the shoe.

One of the main drawbacks linked to these known solutions is related to the fact that the user may feel a sensation of relative instability due to the possibility of oscillation provided for the guide element.

The oscillation may in fact be felt on the handlebar even when the bicycle is kept at a constant inclination, for example when the user gets up from the saddle to simulate a sprint or to perform particular exercises during training.

A further drawback of the solution described in WO 2019/018416 is also linked to the movement by means of a belt which may prove to be not very reliable over time.

Therefore, the problem underlying the present invention is that of providing a support device for front wheels of bicycles structurally and functionally conceived to at least partially obviate one or more of the drawbacks mentioned with reference to the cited prior art.

A further object is to provide a support device for a front wheel which is able to compensate in an appropriate manner the variations in distance between the support area of the front wheel hub and the axis of the rear wheel which take place when the bicycle is tilted up or down.

It is also an object of the invention to provide a support device for a front wheel which is capable of providing sufficient stability to the user during training practice.

SUMMARY

This problem is solved and these objects are achieved, at least in part, by the invention by means of a support device for a bicycle front fork which comprises a support structure intended to be rested on a support surface, a fixing group configured to retain the front fork and supported on the support structure.

The support device preferably comprises a device for translating the fixing group configured in such a way as to move the fixing group in the vertical direction and connection means configured for slidingly constraining said fixing group to said support structure in such a way as to allow displacements of the fixing group with respect to the support structure along a compensation direction C transversal, and preferably perpendicular, to the vertical direction.

It will be appreciated that the possibility of moving the fixing body with respect to the support structure allows, during cycling training on rollers or trainers, to compensate for the distance of the fixing group with respect to the position of the rear axle of the bicycle.

In this way, the upward or downward displacement of the front of the bicycle may be carried out, thus simulating a slope situation, while ensuring maximum stability of the structure as the fixing body is slidingly constrained to the support structure placed on the ground.

In some embodiments of the invention, the translation device comprises a guide element with a preferably vertical extension. Preferably, such guide element has the shape of an elongated column.

These features allow for creating a solid and at the same time compact structure, suitable for lifting/lowering the fork of the bicycle with respect to a neutral position which coincides with that which the bicycle would normally have when moving on flat ground.

Preferably, the translation device comprises a support base. The guide element is connected to the support base. In some embodiments, the support base has a substantially rectangular shape. Preferably, the support structure has an elongated shape in such a way as to define a longitudinal direction, the compensation direction being substantially parallel to the longitudinal direction.

Based on another aspect, the connection means comprise a pair of rails and respective shoes sliding in said rails. The support structure may comprise the rails and the translation device may comprise the shoes, or vice versa.

These features allow for obtaining a sliding constraint between the fixing body and the support structure in a simple, robust and, consequently, reliable manner over time.

In some embodiments, each of said rails comprises a first and a second portion arranged at opposite ends of said support structure along said compensation direction.

In some embodiments, the sliders may preferably comprise rollers. The rollers may, for example, be rotatably connected to the support base by means of pins. Preferably, the rails comprise windows through which said pins pass.

According to still further aspects of the invention, the translation means comprise means for actuating the fixing group configured to translate the fixing group along said vertical direction, which preferably comprise a screw and an internally threaded bush, said fixing group being connected to said bush. Preferably, the actuation means comprise an anti-rotation device of the bush with respect to the column guide element, in such a way as to obtain the translation of the movable element following the rotation of the screw.

Preferably, the fixing group comprises retaining means configured in such a way as to define a locking axis of the fork, preferably coinciding with the front wheel axle of the bicycle when the fork is fixed to the fixing group.

In some embodiments, the retention means comprise a first and a second locking element, each locking element being configured so as to lock a respective arm of the fork, said locking elements being aligned along said locking axis. Preferably, the compensation direction is transverse to said locking axis.

By virtue of these features, it is possible to effectively lock the front fork, ensuring the stability of the bicycle during training.

In some embodiments, the retention means are rotatably supported on the fixing group in such a way as to allow limited rotations of the retention means with respect to an axis of rotation preferably parallel to the vertical direction. Preferably, the locking axis forms an angle between 90° and 60° with the compensation direction.

By virtue of these features, the device of the present invention allows for carrying out rotational movements of the bicycle handlebars during training. The training experience may therefore be particularly similar to real road cycling.

According to another aspect, the invention also relates to the use of the aforementioned support device for cycling training.

Based on a still further aspect, the invention relates to a cycling training kit comprising the aforementioned support device and a rear wheel training device, such as a roller or a trainer.

Advantageously, the support device for the fork and training device for the rear wheel are configured in such a way that the compensation direction defined by the support device coincides with the longitudinal extension direction of the bicycle.

Further preferred features of the invention are more generally defined by the dependent claims.

BRIEF DESCRIPTION OF THE DRAWINGS

These features and the advantages associated with them will become more apparent from the detailed description of some preferred embodiments of the invention, which will be illustrated, by way of non-limiting example, with reference to the accompanying drawings, in which.

DETAILED DESCRIPTION OF THE PREFERRED EMBODIMENTS

Figure 1:
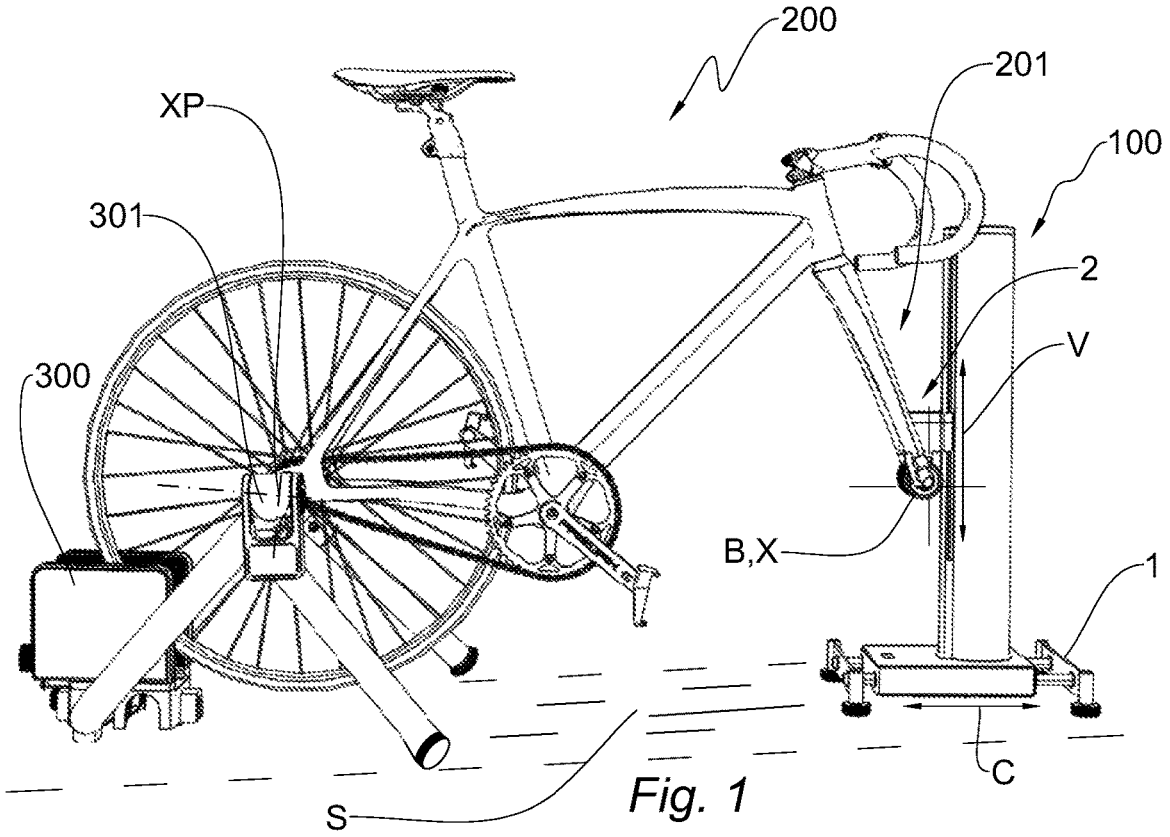
FIG. 1 is a side view of a support device according to the present invention during use for cycling training in association with a bicycle roller.

With initial reference to FIG. 1, a support device for a bicycle front wheel 200 is indicated as a whole with the reference numeral 100.

The support device 100 of the present invention may be advantageously used in combination with a training device 300, for example a roller or a trainer, which comprises a support 301 through which the bicycle may be supported at its rear wheel axle. The training device 300 is configured in such a way as to allow simulation of pedaling.

For this purpose, the device 300 is advantageously provided with a brake, such as a magnetic, fan, hydraulic or electromechanical brake, to counteract the user's pedaling, which is transmitted either by one or more toothed pinions on which the chain meshes or by means of a roller driven by friction by the rear wheel tire. In other words, the device of the present invention may form a training kit together with a device 300 or other similar system.

As may be seen from the figure, during training the fork 201 of the bicycle is fixed to the support device 100, according to methods described in greater detail below.

Figure 2:
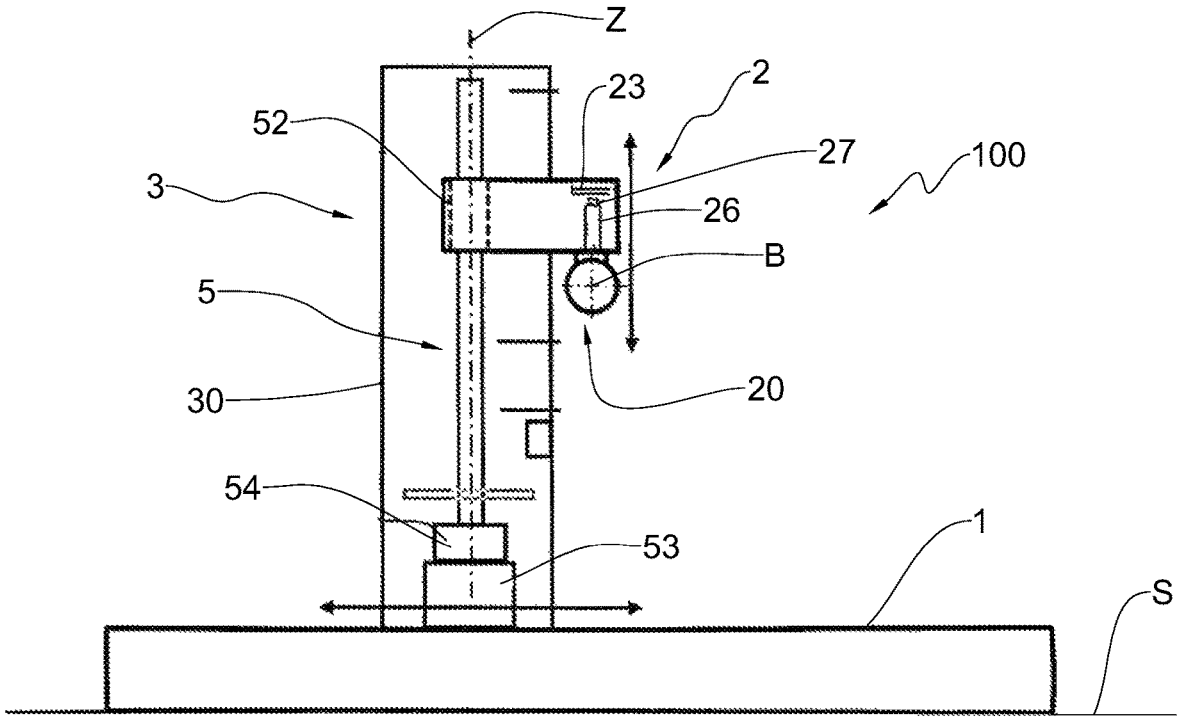
FIG. 2 is a schematic illustration of the support device of the present invention, partially in section.

With reference now also to FIG. 2, the support device 100 comprises a support structure 1 intended to be placed on a substantially flat support surface S, for example the floor of a room in which training is carried out.

Still with reference to FIGS. 1 and 2, the support device 100 further comprises a fixing group 2 configured to retain the front fork 201.

Figure 3:
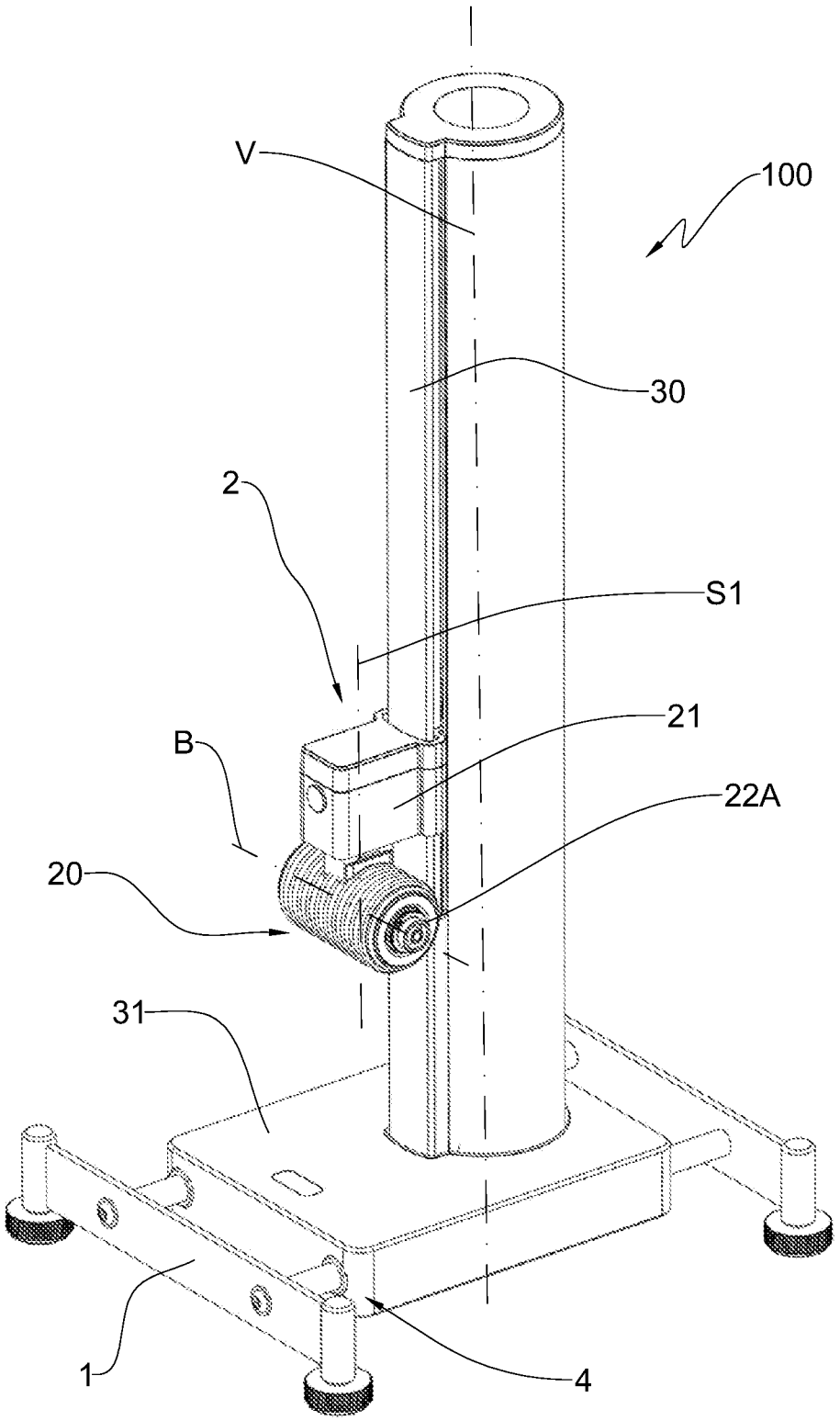
FIG. 3 is a perspective view of the support device of FIG. 1.

As illustrated in FIG. 3, in some embodiments the fixing group 2 may comprise retention means 20 configured in such a way as to define a locking axis B of the fork 201.

Preferably, the retention means 20 comprise a first and a second locking element 21, 22, each configured in such a way as to lock a respective arm of the fork 201.

The locking elements 21, 22 may for example be made in the form of pins, in such a way as to define a fixing structure similar to that defined by the ends of a common bicycle wheel hub.

It will therefore be appreciated that when the fork 201 is fixed to the fixing group 2, the locking axis B coincides with the front wheel axis X of the bicycle 200.

With reference again to FIG. 2, the support device 1 comprises a translation device 3 of the fixing group 2 which includes a guide element 30 preferably in the shape of an elongated column.

In some embodiments, the fixing group 2 may slide on the guide element 30 in such a way as to allow displacements in the vertical direction V of the fixing group 2 and, in particular, of the retention means.

In this way, the front end of the bicycle 200 may be raised or lowered, allowing it to be placed during training in a position similar to that which occurs on an uphill or downhill road.

Figure 6:
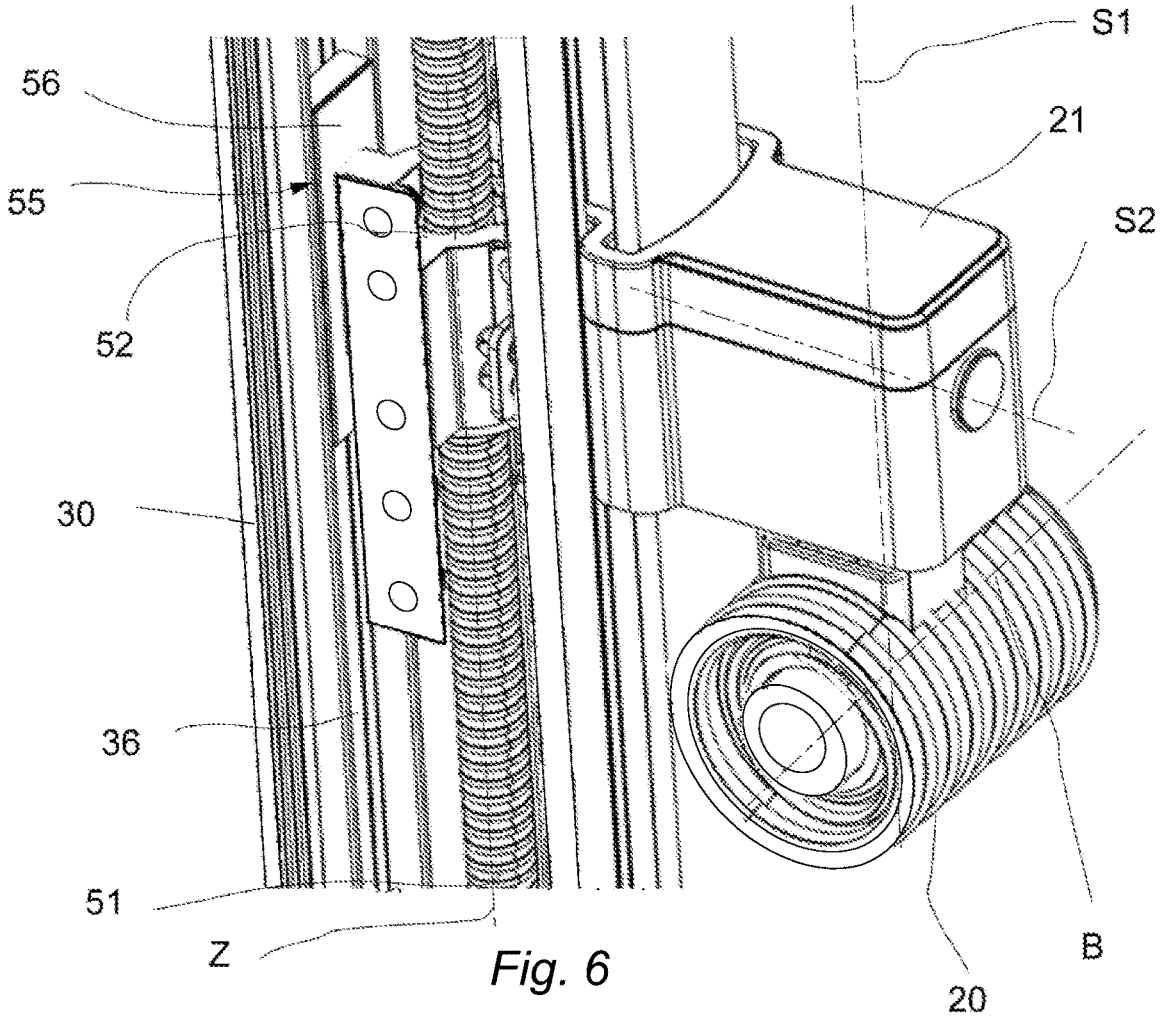
FIG. 6 is a perspective view, in detail and partially in section, of the support device of FIG. 1.

With reference now also to FIGS. 2 and 6, the movement of the fixing group 2 in the vertical direction takes place by means of suitable actuator 5.

Preferably, these actuation means 5 comprise a screw 51 and an internally threaded bush 52. The screw is rotated around an axis Z preferably coinciding with the vertical axis V, by means of an electric motor 53 which may be associated with a reducer 54.

The fixing group 2 is connected to the internally threaded bush 52 and the rotation of the screw 51 determines the displacement of the group 2 along the axis Z of the screw, the group 2 being itself slidingly constrained along the guide element 30.

In this way, the vertical position of the fixing group 2, and therefore of the front of the bicycle, may be easily controlled by means of a control system, thus allowing the optimal implementation of interactive training solutions.

In preferred embodiments, the actuation means 5 are housed inside the column which forms the guide element 30, with the motor 53 and the reducer 54 positioned at the base thereof.

Preferably, the actuation means 5 comprise an anti-rotation device 55 of the bush 52 with respect to the column guide element 30, in such a way as to obtain the translation of the movable element 21 following the rotation of the screw 51. In some embodiments, the rotation device comprises sliding shoes 56 sliding into relative seats 36 formed in the guide element 30.

With reference again to FIG. 2, the translation device 3 may comprise a support base 31, which preferably has a substantially rectangular shape.

The guide element 30 is advantageously connected to this support base 31 and extends vertically therefrom.

According to an aspect of the invention, the support base is connected to the support structure 1 by means of suitable connection means 4 which allow the sliding of the base 31 with respect to the support structure 1 along a compensation direction C perpendicular to the vertical direction V.

It will be appreciated that the sliding of the base 31 determines a corresponding sliding of the fixing group 2 and, more generally, the connection means may also be configured differently, as long as they are suitable for slidingly constraining the fixing group 2 to the support structure 1 in such a way as to allow displacements of the group 2 along the compensation direction C.

As may be seen from FIG. 1, the displacements of the fixing group 2 along the compensation direction C allow the locking axis B to be brought closer/further away with respect to the training device 300. In this way, the correct distance between the training device 300 and the support device 100 may therefore be maintained following the inclination of the bicycle around its rear axle XP.

In some embodiments, the bicycle 200 may be fixed to the training device 300 in such a way that it may rotate, as a whole, around the rear axle XP. This allows for avoiding sliding at the locking zone between the bicycle 200 and the training device 300 during upward or downward inclination.

It will also be appreciated that although in the embodiment shown in the figure the compensation direction substantially coincides with a horizontal direction parallel to the longitudinal extension of the bicycle, embodiments may be provided in which the compensation direction C is inclined with respect to these directions, provided it is not parallel to the vertical axis and the rear axis of the bicycle.

However, it is preferable that the compensation direction C is substantially parallel to the longitudinal extension direction of the support structure 1.

Figure 4:
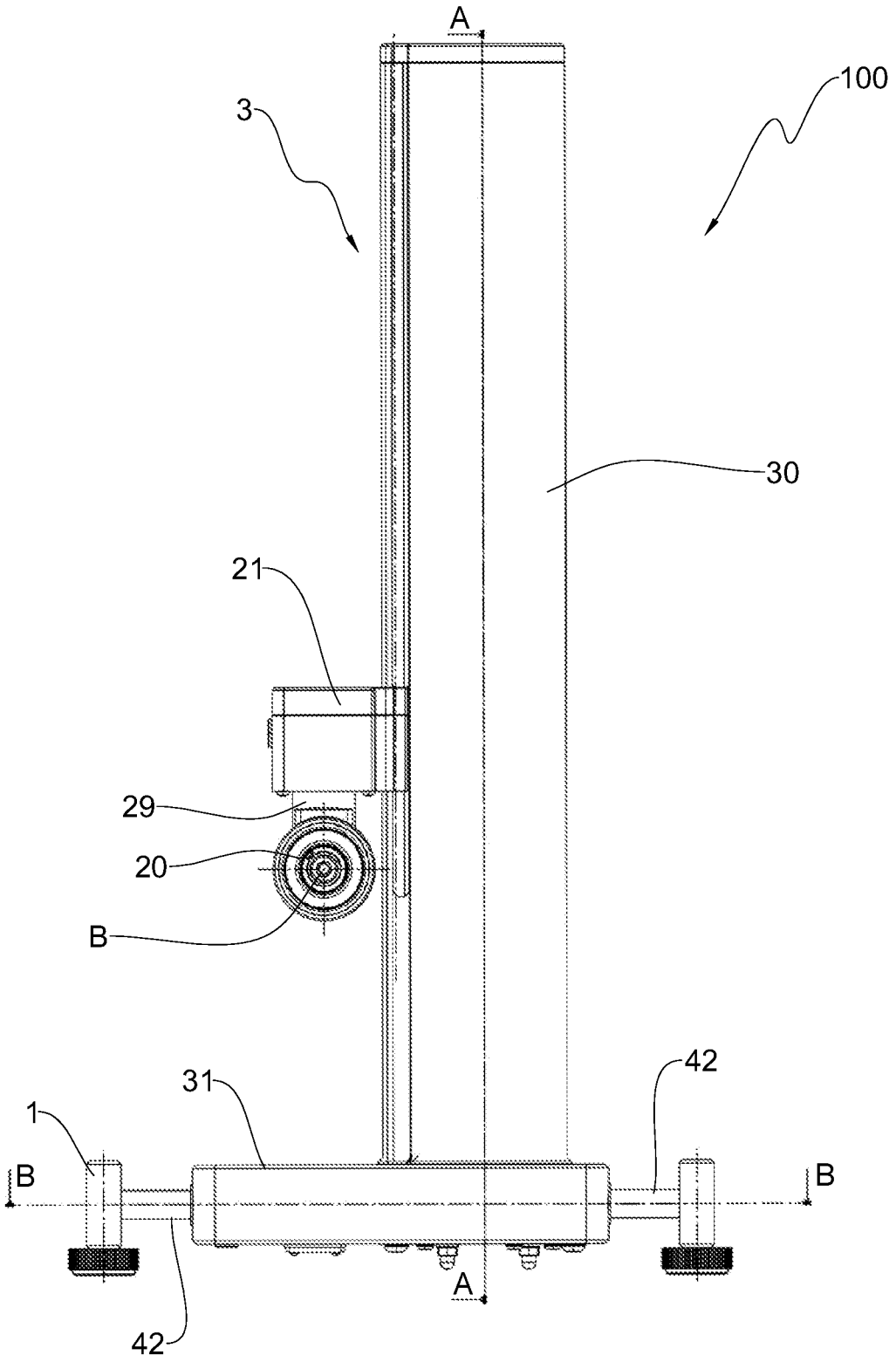
FIGS. 4, 4A and 4B are a side view from above and respective transverse and longitudinal sections of the support device of FIG. 1.
Figure 4A:
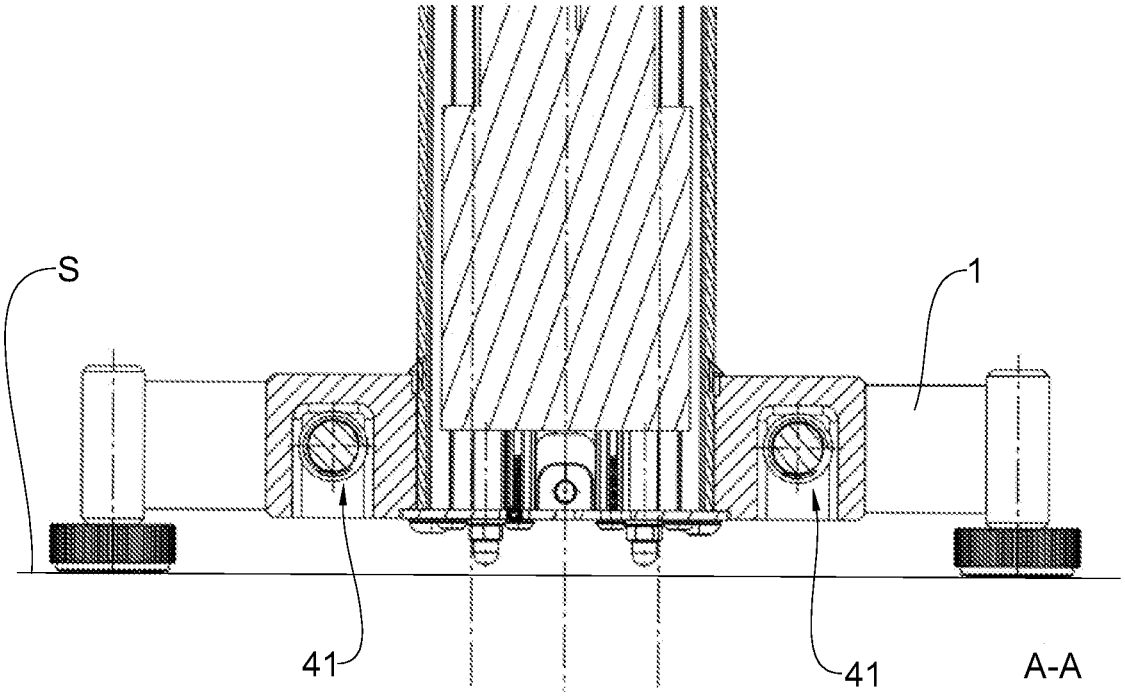
Figure 4B:
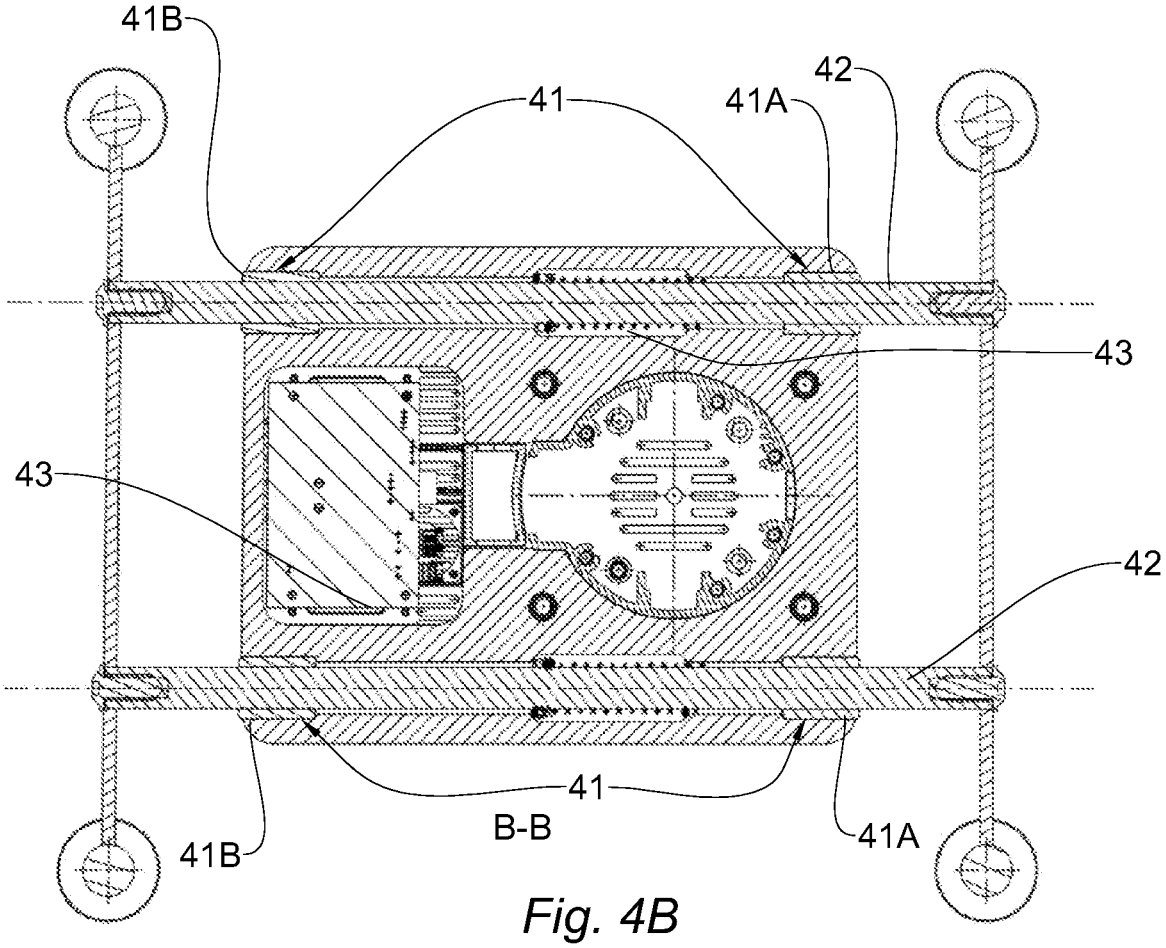

With reference now also to FIGS. 4A and 4B, a possible implementation of the connection means 4 will be described.

In particular, in preferred embodiments the connection means may comprise a pair of rails 41 and respective sliders 42. Preferably there are two pairs of rails and respective sliders, formed at transversely opposite ends of the device 100.

In some embodiments, the rails 41 are formed in the support structure 1 while the sliders 42 are supported on the lifting/lowering device 3. However, it is clear that the opposite solution may also be contemplated.

Preferably, the sliders 42 are in the form of rods sliding in said rails 41.

In some embodiments, each of the rails 41 may comprise a first and a second portion 41A, 41B arranged at opposite ends of the support structure 1 along the compensation direction C. A return element 43 may also be provided, configured in such a way as to urge the lifting/lowering device 3 in an intermediate position along said compensation direction C between respective limit positions.

Figure 7A:
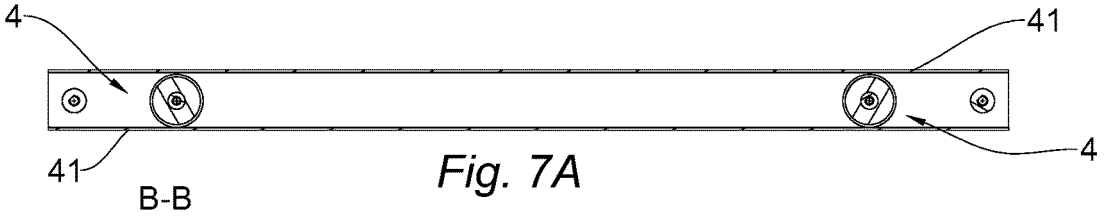
FIGS. 7, 7A and 7B are top and side views of an alternate embodiment of the support device of FIG. 1.
Figure 7B:
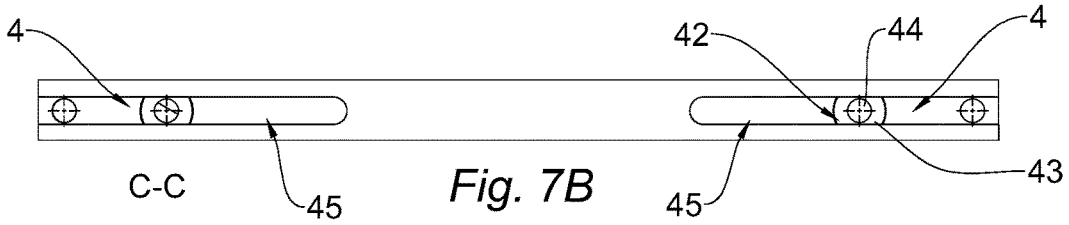
Figure 7:
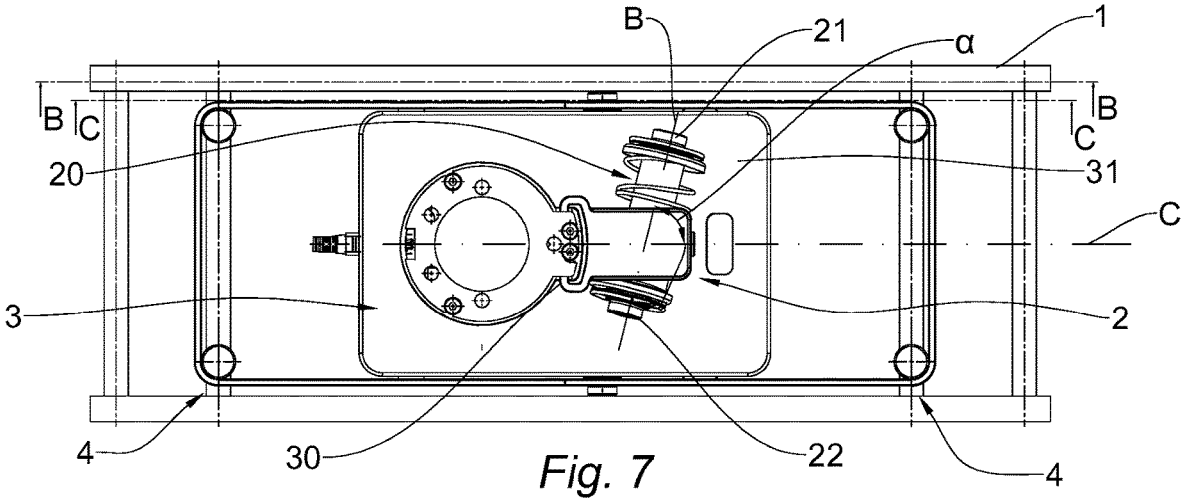

In alternative embodiments, illustrated for example in FIGS. 7, 7A and 7B, the sliders 42 may comprise rollers 43, sliding in said rails 41. Preferably there are two pairs of rails and respective sliders, formed at longitudinally opposite ends of the device 100.

The rollers 43 may, for example, be rotatably connected to the support base 31 by means of pins 44. In this case, the rails 41 advantageously comprise windows 45 through which the pins 44 pass.

The rollers 43 may therefore slide inside the rails 41 allowing a sliding connection between the support structure 1 and the base 31 or, more generally, between the support structure 1 and the fixing group 2.

With reference again to FIG. 3, according to another aspect of the invention, the retention means 20 may be rotatably supported on the fixing group 2 in such a way as to allow limited rotations of the retention means 20 with respect to an axis of rotation S1, preferably parallel to said vertical direction V.

As illustrated in FIG. 6, according to another aspect the retention element 20 may be rotatable with respect to the movable element 21, also with respect to a secondary axis S2 perpendicular to the locking axis B and to the main axis S1. The secondary axis S2 is preferably substantially horizontal.

Advantageously, the retention element 20 may also be translatable along the locking axis B.

Figure 5:
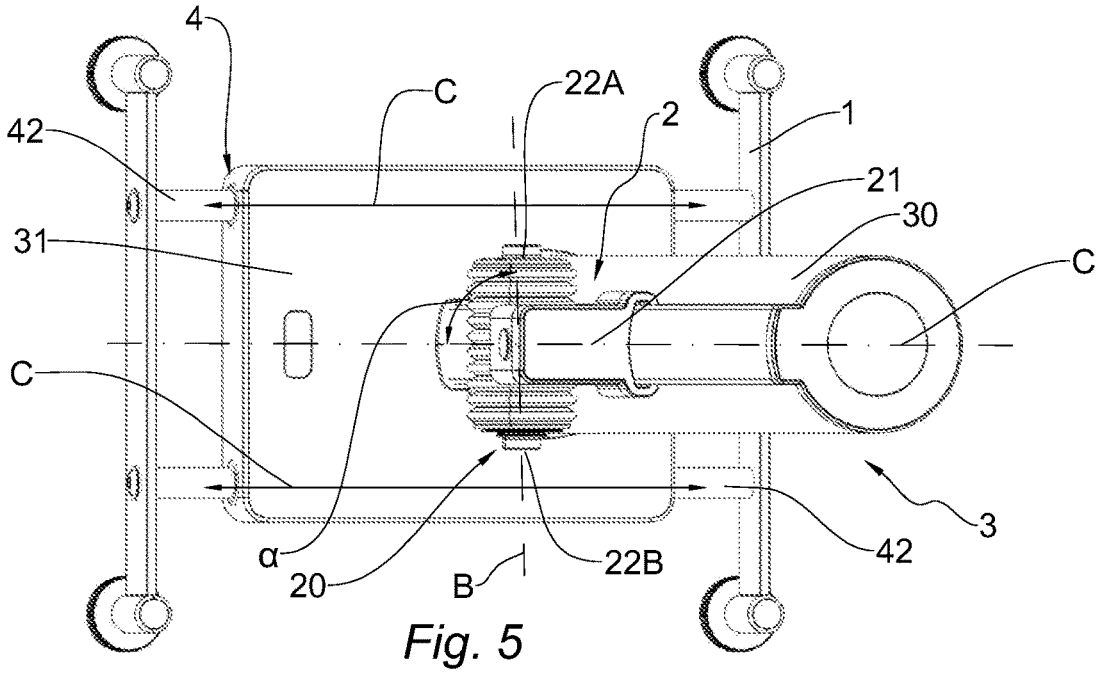
FIG. 5 is a top view of the support device of FIG. 1.

As shown schematically in FIG. 5, the connection of the retention means 20 on the fixing group 2 may be configured in such a way that the retention means 20 may rotate so that the locking axis B forms a variable angle $\alpha$ with said compensation direction C. Preferably, such angle $\alpha$ may be comprised between 90° and 60°, where 90° corresponds to the straight position of the fork 201. In this way, handlebar rotations of approximately ±30° with respect to its central position may be allowed.

It will therefore be appreciated that a support device thus made may allow for simulating, in a training session, conditions for the front of the bicycle particularly similar to those which occur during the actual cycling practice. This may be desirable, for example, in the case in which it is desired to simulate in a realistic manner the upward or downward progress.

At the same time, the bicycle is supported in a stable and safe manner, for the benefit of the user's safety and comfort.

In addition, the ability to rotate the handlebar, also in combination with the upward and downward action of the front axle, helps to bring the training experience even closer to the real one.

The invention claimed is:

1. A support device for a bicycle, the bicycle including a front fork, said support device comprising a support structure which is configured to be supported on a substantially planar support surface, a fixing group which is configured to retain the front fork and which is supported on the support structure, a translation device of said fixing group which is configured so as to move said fixing group in a vertical direction, wherein said translation device comprise an actuator of said fixing group which is configured to move said fixing group in translation along said vertical direction, said fixing group being slidingly secured to said support structure so as to allow movements of said fixing group with respect to said support structure along a compensation direction which is transverse to said vertical direction.

2. The support device according to claim 1, wherein said translation device comprises a guide element, which extends vertically.

3. The support device according to claim 2, wherein said guide element is an elongate column.

4. The support device according to claim 3, wherein said translation device comprises a support base, said guide element being connected to said support base.

5. The support device according to claim 1, further comprising a pair of rails and respective sliders which can slide in said rails, and wherein said support structure comprises said rails and said translation device comprises said sliders, or said support structure comprises said sliders and said translation device comprises said rails, said rails and said respective slider slidingly securing said fixing group to said support structure.

6. The support device according to claim 5, wherein said sliders comprise rollers, said rollers rotatably connected to said support base by pins.

7. The support device according to claim 1, wherein said actuator comprises a screw and an internally threaded bush, said fixing group being connected to said internally threaded bush.

8. The support device according to claim 1, wherein said fixing group comprises a retention device which is configured so as to define a locking axis of the front fork, said locking axis coinciding with a front wheel axle of the bicycle when the front fork is fixed to said fixing group.

9. The support device according to claim 8, wherein the retention device comprise a first and a second locking element, each locking element being configured so as to lock a respective arm of the fork, said locking elements being aligned along said locking axis.

10. The support device according to claim 8, wherein said compensation direction is transverse to said locking axis.

11. The support device according to claim 8, wherein said retention device is rotatably supported on said fixing group so as to allow limited rotations of said retention device with respect to a rotation axis which is parallel to said vertical direction, wherein said locking axis defines an angle between 90° and 60° with said compensation direction.

12. The support device according to claim 1, wherein said support structure has an elongate form so as to define a longitudinal direction, said compensation direction being substantially parallel to said longitudinal direction.

13. A method of using the support device according to claim 1 for cycle training, wherein the front fork of the bicycle is fixed to said fixing group in such a manner that a front wheel axle of the bicycle is transverse to said compensation direction.

14. A kit for cycle training comprising the support device according to claim 1, and a training device for the bicycle, the training device comprising a support for a rear axle of the bicycle, said support device and training device being configured in such a manner that said compensation direction coincides with a longitudinal extension direction of the bicycle.

15. A support device for a bicycle, the bicycle including a front fork, said support device comprising a support structure which is configured to be supported on a substantially planar support surface, a fixing group which is configured to retain the front fork and which is supported on the support structure, a translation device of said fixing group which is configured so as to move said fixing group in a vertical direction said fixing group being slidingly secured to said support structure so as to allow movements of said fixing group with respect to said support structure along a compensation direction which is transverse to said vertical direction, wherein said fixing group comprises a retention device which is configured so as to define a locking axis of the front fork, said locking axis coinciding with a front wheel axle of the bicycle when the front fork is fixed to said fixing group, said retention device being rotatably supported on said fixing group so as to allow limited rotations of said retention device with respect to a rotation axis which is parallel to said vertical direction.

16. A support device for a bicycle, the bicycle including a front fork, said support device comprising a support structure which is configured to be supported on a substantially planar support surface, a fixing group which is configured to retain the front fork and which is supported on the support structure, a translation device of said fixing group which is configured so as to move said fixing group in a vertical direction, a pair of rails and respective sliders which can slide in said rails, said support structure comprising said rails and said translation device comprising said sliders, or vice-versa, wherein said rails and said respective sliders are configured to slidingly secure said fixing group to said support structure so as to allow movements of said fixing group with respect to said support structure along a compensation direction which is transverse to said vertical direction such that the front fork of the bicycle is displaced horizontally when said fixing group is moved in the vertical direction by said translation device.

* * * * *